United States Patent [19]

Bohn et al.

[11] 4,083,604

[45] Apr. 11, 1978

[54] THERMOMECHANICAL FRACTURE FOR RECOVERY SYSTEM IN OIL SHALE DEPOSITS

[75] Inventors: Jack R. Bohn, Rancho Palos Verdes; Durk J. Pearson, Palos Verdes Estates, both of Calif.

[73] Assignee: TRW Inc., Redondo Beach, Calif.

[21] Appl. No.: 741,820

[22] Filed: Nov. 15, 1976

[51] Int. Cl.[2] ..... E21B 43/24; E21B 43/28

[52] U.S. Cl. ..... 299/4; 166/251; 166/259

[58] Field of Search ..... 299/1, 4, 5, 13; 175/58, 59; 166/259, 302, 303, 308, 250, 251, 252

[56] References Cited

U.S. PATENT DOCUMENTS

| | | | |
|---|---|---|---|
| 2,661,066 | 12/1953 | Bond | 166/308 X |
| 3,465,826 | 9/1969 | Terwilliger et al. | 166/308 X |
| 3,502,372 | 3/1970 | Prats | 299/5 |
| 3,539,221 | 11/1970 | Gladstone | 299/14 |
| 3,753,594 | 8/1973 | Beard | 299/4 |
| 3,759,328 | 9/1973 | Veber et al. | 299/4 |
| 3,759,574 | 9/1973 | Beard | 299/4 |
| 3,779,601 | 12/1973 | Beard | 299/4 |
| 3,957,306 | 5/1976 | Closmann | 299/4 |

*Primary Examiner*—Ernest R. Purser
*Attorney, Agent, or Firm*—John J. Connors; Benjamin DeWitt; Donald R. Nyhagen

[57] ABSTRACT

In a process for the recovery of resources from underground geological structures, the process is improved by fracturing the walls of the underground structure and large boulders or rocks by inducing thermal gradients in the deposits. Determination of the thermal gradients which will produce the desired fracturing pattern in each specific deposit involves subjecting a core sample to a controlled heating program. When the heating program has been established from tests on the core sample, it is then applied to the underground formation.

14 Claims, No Drawings

THERMOMECHANICAL FRACTURE FOR RECOVERY SYSTEM IN OIL SHALE DEPOSITS

BACKGROUND OF THE INVENTION

In-situ processes are governed by the subsurface structure, the process fluid flows, and their interactions. A major problem with in-situ processes has been to establish intimate contact between the process fluids and the deposits, and to establish sufficient porosity or fractures to permit process fluid circulation. It is important that the fracture of the deposit is sufficiently fine so that the process proceeds at a sufficient rate with a high enough efficiency to be economic, but not too fine because fluid flow pressure drop in a packed bed increases by an order of magnitude for a bed particle size reduction of 2, thereby increasing fluid pump or compressor and piping capital and operating costs by a similar amount. There are numerous fracture techniques which are currently in use, among which are explosions, hydrofracture, leaching a soluble phase, electrofracture, abrasive cutting, and acids, to name a few.

Where these fracture techniques were applied to oil shale deposits, explosives were the most commonly used. In this potentially dangerous approach, underground tunnels were carved into the oil shale deposits in a predetermined pattern for the purpose of blasting and rubblizing the deposit. In performing the blasting process, care was required to leave sufficient support so that the entire overburden of the deposit was not collapsed into the tunnel voids. Considerable difficulty was experienced in rubblizing the oil shale deposit to produce rubble of the appropriate size which would support a reasonably uniform flame front for the retorting of the hydrocarbon values in the shale. If the rubble was not reasonably uniform and of proper size, a substantially uniform flame front was not maintained, and process and product gases mixed and reacted which contributed to the quenching of the desired retort flame front and reduced product recovery. Thus, much time and consideration was given to the blasting patterns which were used to rubblize the oil shale deposits, and even then the fracturing patterns produced were frequently by chance.

SUMMARY OF THE INVENTION

The present invention relates to an in-place method for the recovery of mineral values from subsurface deposits. More particularly, the present process relates to a method for producing a fracturing pattern in subsurface oil shale deposits.

By properly injecting heat into the subsurface deposits, full control of fracturing can be achieved, i.e. from promotion to inhibition. Where a fracturing pattern is sought for a particular subsurface deposit, a core sample of the deposit is first extracted. The core sample is subjected to a particular heating schedule to induce the proper thermal gradients into the core sample so as to promote measured and controlled strain and fracturing. In general, more extreme thermal gradients will lead to more extensive fracturing and a smaller average particle size. When the thermomechanical characterization of the core sample has been completed, the heating schedule computed from the thermomechanical characterization of the core is applied to the subsurface deposit to produce the desired fracturing pattern.

DETAILED DESCRIPTION OF THE INVENTION

Non-steady state thermal stresses arise as a result of transient temperature gradients in a body and the corresponding differential thermal expansion which cannot be accommodated by geometrically compatible displacement within the body. These stresses continually adjust themselves in such a way that the internal forces in the body are self-equilibrating and the displacements are compatible. If, in the process, either the stresses or the strains reach some critical value, failure may occur.

In general, either fracture or excessive deformation may be taken as the critical failure mode. The expression "thermal shock" has been defined by materials investigators as catastrophic brittle fracture which occurs as a result of high tensile stresses which are generated at the cooler side of transiently heated bodies. These same tensile forces might instead produce excessive deformation in a body if the material were strong enough to resist fracture, or if it were ductile rather than brittle. Even if the deformation were not excessive during a single heating and cooling cycle, multiple cycling can lead to an accumulated deformation which eventually will become excessive.

One mode of failure for in-situ processing involves both plastic flow and fracture near the heated surface of the body. Regions of checking or cracking have been noted near the heated surface where compressive plastic flow has occurred during heating. It has recently been discovered that the reversal of stress at the hot surface, from compressive to tensile, and the reversal of plastic flow from compressive to tensile, occurs not when the body cools but earlier in the cycle, i.e. as soon as the temperature gradient begins to disappear. This will happen even if the overall temperature of the body is still increasing, as might be the case during sustained heating. Thus, the heated surface material might be put into tension, which would be multiaxial tension in most cases, while it is still very hot to the point of approaching melting, and ductile fracture or hot tearing would very easily take place. Cracking of this nature could also lead to loss of material at the hot surface which might be mistaken for compressive spallation in any post-test evaluation.

In order to apply the theoretical considerations previously set forth, a core sample from the deposit which is to be extracted is subjected to a heating schedule to determine the thermomechanical characteristics of the deposit material. Geneally, more extreme thermal gradients will lead to more extensive fracture and a smaller average particle size, while larger average particle sizes will result from more gradual thermal gradients.

These thermomechanical fractures will occur in three principle modes. In one mode, the hot retort wall (or surface of a boulder or rock) is put into compression compared to the cooler surrounding strata, and failure occurs in compression by buckling or spallation. In another mode, the hot inside wall is put into compression compared to the cooler surrounding strata which then fail in tension. In the third mode, the hot inside wall is put into compression and undergoes plastic flow during the period when the thermal gradient is relative high. As the heat spreads outward and the thermal gradient becomes less steep, a more distant material heats up, expands, and causes a tensile hot tearing failure at the hot inner wall.

It should be noted that with the proper temperature versus time cycles that it is possible to preferentially comminute large boulders, blocks, and the cavity walls while exercising a lesser size reduction effect on smaller pieces of rubble. This is because the surface area to volume ratio of the former is smaller than that of the latter. Because of this, the former rocks can be subjected to larger thermal gradients for longer periods of time than is the case with smaller rubble which heats up in its interior relatively rapidly. As a result, the proper temperature versus time cycles can yield a more uniform rubble bed with fewer hugh blocks which are wasted resource because of inefficient extraction, and fewer fines which greatly decrease bed permeability, hence greatly increase the process system's capital and operating costs.

Thermomechanical control of fracture can be applied to oil shale deposits to effect proper rubblization of the deposits so that mineral and hydrocarbon value extraction may be optimized. One particular area which has rich oil shale deposits as well as rich mineral deposits, is the Piceance Creek Basin in northwestern Colorado. This area contains recoverable oil shale, nahcolite, and dawsonite which lends itself to an integrated in-place process that first extracts nahcolite and is followed by shale oil recovery, alumina recovery, and finally residual fuel values recovery. In order for as much as possible of the mineral and hydrocarbon values to be recovered, the process must be conducted in a sequence of specific steps. In the first step, a core hole is drilled into the shale deposit, and the core is extracted. The core sample is then subjected to controlled heating combined with strain measurements and computation to determine the thermomechanical characteristics of the minerals and hydrocarbon values in the deposit. When the thermomechanical characteristics of a particular portion of the deposit has been determined, an injection well and producer wells are sunk into the deposit. These may be coaxial, i.e. in the same hole, such as a reamed out bore hole. Steam is injected into the shale deposit to fracture the deposit according to the fracturing parameters of temperature versus time determined by the core sample tests and calculations and to remove the nahcolite mineral by leaching. The nahcolite leach, together with the thermomechanical fracturing, will produce a rubblization of the shale deposit which will render the deposit permeable and porous.

Upon completion of the nahcolite removal, the resulting gas-tight chamber may be tested to determine if sufficient rubblization has occurred. If further rubblization is required, the chamber may be exposed to further thermal cycling so as to produce the desired particle size which will result from the further fracture of the rubble. By continual monitoring of the rubble in the chamber, close control may be exercised over the chamber conditions.

After creating porosity in the formation by leaching the water soluble nahcolite from the shale zone, and by inducing thermomechanical fracture, the chamber is pumped dry and in-situ retorting of the oil shale can be accomplished by the circulation of a hot, pressurized, non-oxidizing fluid, such as heated low molecular weight hydrocarbon gas, steam, heated retort off-gas, comprising $H_2$, CO, $N_2$, $CO_2$, and mixtures thereof from the injection well through the permeable shale bed and out the producing well. During the retorting process, heat is transferred from the hot fluid to the shale, causing the kerogen and dawsonite to decompose according to the following idealized reactions:

$$\text{kerogen} \rightarrow \text{bitumen} \rightarrow \text{oil} + \text{gas} + \text{residue} \quad (1)$$

$$2NaAl(OH)_2CO_3 \rightarrow Na_2CO_3 + Al_2O_3 + 2H_2O + CO_2 \quad (2)$$

$$NaAl(OH)_2CO_3 \rightarrow NaAlO_2 + CO_2 + H_2O \quad (3)$$

Neither reaction (2) nor (3) represents the sole mechanism for dawsonite decomposition, although it is known that reaction (3) is the predominant one at the higher temperatures and reaction (2) is almost non-existent at temperatures above 650° F.

The in-situ retorting process should be carried out in the temperature range of 660° to 930° F, and preferably between 800° and 850° F. These temperature ranges will permit rapid completion of the oil evolution from the raw shale, and the decomposition of dawsonite to chi-alumina which occurs about 660° F. In addition, co-occurring with the dawsonite is the nordstrandite which forms difficult to leach gamma-alumina at temperatures above 930° F. The retorting of oil shale at temperatures in the range of 800° to 850° F leads to a quality shale oil product with a typical pour point about 25° F, and API gravity of about 28° and a nitrogen content of less than 0.8 weight percent according to Hill and Dougan in *The Characteristics of a Low-Temperature In-Situ Shale Oil,* Quarterly of the Colorado School of Mines, Volume 62, No. 3, July 1967. In contrast, the shale oil from high temperature retorting can have a pour point of as high as 90° F and API gravity of about 20° and a nitrogen content of approximately 4 weight percent. Thus, the shale oil product from the low-temperature process may be readily transported to refineries by a pipeline, and on-site upgrading becomes optional.

If the recovery of hydrocarbon values are not as great as estimated, thermal cycling may be performed using the retorting gas as the medium. Constant monitoring of the permeability of the shale bed should be conducted to note changes in pressure versus flow relation. Excessive comminuation with its accompanying high pressure drop should be avoided.

Pressures for the in-situ retorting process will depend upon the permeability of the shale bed, the height and density of the overburden, and the heat capacity and circulation rate of the hot fluid. A higher pressure minimizes the volume of recirculating hot fluid required, but this could lead to a considerable drop in the yield of shale oil according to Bae, *Some Effects of Pressure in Oil Shale Retorting,* Society Petroleum Engineers Journal, No. 9, Page 243.

Oil vapor from the decomposition of kerogen is cooled by the formation ahead of the retorting front and condenses and drains into a pocket from which it can be pumped along with some water from dawsonite decomposition. The off-gas produced by the kerogen in the retorting process includes four components comprising the hot fluid used for retorting, the hydrocarbon gas from the kerogen decomposition, hydrocarbon oil vapors, and the carbon dioxide and water vapor from the dawsonite decomposition. If the gas from kerogen decomposition is used as the heat carrier for retorting, the resulting off-gas will have a medium heating value after the removal of the water and $CO_2$.

In the retorting of each shale member, the recirculating fluid has only to be externally heated during the first part of the retorting period. After approximately half of the shale bed chamber has been retorted, cooler fluid can be injected into the formation and heated by the hot, retorted shale bed. Thus, waste heat can be recovered from the first half of the retorted shale bed and used for retorting of the remaining portion of the shale.

After the retorting step has been completed, alumina which was formed from dawsonite and nordstrandite can be extracted. This light base extractable alumina which was created when the oil shale was retorted at moderate temperatures, was formed by dawsonite when it was heated to 350° C according to the following reaction as reported by Smith and Young in *Dawsonite: Its Geochemistry, Thermal Behavior, and Extraction from Green River Oil Shale,* paper presented at the Eighth Oil Symposium, Colorado School of Mines, Golden, Colo., April 17–18, 1975:

$$2NaAl(OH)_2CO_3 \rightarrow Na_2CO_3 + Al_2O_3 + 2H_2O + CO_2 \quad (2)$$

This alumina which includes values from nordstrandite, can be extracted from the retorted oil shale by solution of 1 N sodium carbonate and a nonionic or suitable surfactant such as:

alkanol amines
alkanol amides
polyoxyalkylene oxide block copolymers
carboxylic amides
carboxylic esters
ethoxylated aliphatic alcohols
ethoxylated alkylphenols
polyoxyethylenes
alkyl sulfates
N-acyl-N-alkyltaurates
naphthalene sulfonates
alkyl benzene sulfonates
alkane sulfonates
alkanol amide sulfates
sulfated alkylphenols
phosphate esters The solution equation is represented as:

$$Al_2O_3 + 2CO_3^{=} + H_2O \rightarrow 2HCO_3^{-} + 2AlO_2^{-} \quad (4)$$

As this leach liquor fills the cavity, it creates a water drive to mobilize unrecovered shale oil and float it to the top of the cavity. This oil and pregnant solution can then be removed to the surface.

The alumina recovery facility first transports the recovered liquids to a liquid/liquid separator. The oil then goes to the oil recovery plant, and the aqueous solution is then sent to a clarifier to remove shale fines. Subsequently the liquid is passed through a series of carbon dioxide bubblers where the solution pH is progressively lowered from 11 to 9 causing the alumina to precipitate from solution. The solid is then washed, filtered, and calcined to produce alumina.

Even with good yields from the primary and secondary recovery processes, residual fuel value will remain in the retort bed in the form of unmobilized oil and carbonaceous residue. Although this residue has little direct commercial value, it may yield sufficient fuel value to supply heat for the production of steam for the leach phase, the heating of retorting gas for hot gas retorting in another chamber, and substantial amounts of CO, $H_2$ and liquid and vapor hydrocarbons. In view of this, a tertiary recovery step is effected which comprises removing water of the previous stem from the retort chamber and instituting a flame front to combust the residue. After combustion of the residue has begun, water vapor is injected down the well hole. The water vapor reacts with the residue to hydrogenate the remaining unsaturated hydrocarbon values so that polymerization does not occur. By preventing polymerization of the hydrocarbon values during pyrolysis, the residue is fluid and readily flows in advance of the flame front. In addition, the presence of steam facilitates fossile fuel energy mobilization by means of the water gas reaction:

$$H_2O + C \rightarrow CO + H_2$$

When all practical hydrocarbon and mineral values have been removed from the retort chamber, the chamber is backfilled with water, solutions, or slurries to prevent subsidence of the soil and collapse of the underground structures. Aqueous solutions suitable for this purpose may comprise some of the excess minerals which were removed in some of the previous recovery processes. Thus, if more sodium bicarbonate is being removed than can be disposed of economically, the solutions or slurries of these materials may be pumped back into the ground for storage and later removal. Subsidence of the soil must be controlled to prevent process interruption and to minimize environmental damage. The vertical component of the stress field is governed by unit weight of the rock and the vertical depth in the opening. The reaction to this stress and size of the opening which can be tolerated without collapse will be governed by the strength of the rock immediately above the opening. The chamber roof may be thermomechanically strengthened by processing which introduces residual stresses in the roof which oppose the gravitational stresses.

To minimize soil subsidence, extraction operation must leave pillars of undisturbed shale to support the overburden This technique is commonly used in room and pillar mining. Thus, to reduce the possibility of earth subsidence which follows an initial roof collapse that causes stress and disruption of strata all the way to the earth's surface, back-filling with pressurized water or aqueous solutions or slurries should be considered.

After the chamber has been back-filled, the pipe may be plugged to seal the chamber. When the next level of mining has been determined, the pipe is perforated at that level and the process is repeated.

Each step of the process is integrated and interdependent upon obtaining the inputs of process fuels, chemicals, or working fluids which are supplied as outputs by some other process stage. Thus, it would be impractical to pump large quantities of a basic surfactant into a borehole to recover alumina values unless the chamber had been leached and retorted previously. Likewise, recovery of hydrocarbon values from the oil shale would be difficult and expensive unless the chamber was first made porous and permeable by the nahcolite leach. Therefore, in order to carry out the process in a logical and economic manner, the process steps must be followed in the sequence set forth previously.

Although there may be numerous modifications and alternatives apparent to those skilled in the art, it is intended that the minor deviations from the spirit of the invention be included within the scope of the appended claims, and that these claims recite the only limitations to be applied to the present invention.

We claim:

1. A process for the in-situ recovery of hydrocarbon values and associated minerals from subsurface oil shale deposits in which a gas-tight retort chamber can be produced comprising the steps of:

(A) drilling into and removing a core sample from said oil shale deposits;

(B) subjecting said core sample to controlled heating with accompanying strain measurements to determine the thermomechanical characteristics of the core material from which can be determined the thermal gradients required of said shale deposits so as to produce a fracturing pattern;

(C) injecting steam into said shale deposits to heat said shale deposits correspondingly to the results derived from said core sample heating to produce corresponding fracturing patterns in said shale and to dissolve and extract said associated minerals which are water soluble thereby forming a substantially gas-tight chamber;

(D) injecting hot, pressurized, non-oxidizing gas into said shale deposit in said chamber whereby said associated minerals are decomposed and further fractured with appropriate time-temperature cycles and hydrocarbon fluids extracted;

(E) injecting an aqueous solvent and surfactant into said deposit and extracting said decomposed minerals and hydrocarbon fluids;

(F) removing said solvent-surfactant from said deposit;

(G) instituting a flame front with air and water to combust hydrocarbon residue; and (H) filling said chamber with a fluid selected from the group consisting of water, aqueous solutions, and aqueous slurries.

2. A process according to claim 1 wherein said shale deposit is beneath a layered salt deposit.

3. A process according to claim 1 wherein said associated minerals are selected from the group consisting of nahcolite, dawsonite, nordstrandite, shortite, trona, and halite.

4. A process according to claim 1 wherein said water soluble mineral is selected from the group consisting of halite, trona, and nahcolite.

5. A process according to claim 1 wherein said hot, pressurized gas is selected from the group consisting of low molecular weight hydrocarbons, carbon dioxide, carbon monoxide, hydrogen, nitrogen, steam, and mixtures thereof.

6. A process according to claim 1 wherein said solvent is an aqueous solution of a compound selected from the group consisting of sodium carbonate and sodium bicarbonate, and a surfactant selected from the group consisting of alkanol amines; alkanol amides; polyoxyalkylene oxide block copolymers; carboxylic amides; carboxylic esters, ethoxylated aliphatic alcohols; ethoxylated alkylphenols; polyoxyethylenes; alkyl sulfates; N-acyl-N-alkyltaurates; naphthalene sulfonates; alkyl benzene sulfonates; alkane sulfonates; alkanol amide sulfates; sulfated alkylphenols; and phosphate esters.

7. A process according to claim 1 wherein said decomposed minerals are alumina.

8. A process for the in-situ recovery of hydrocarbon values and associated minerals from subsurface oil shale deposits in which a gas-tight retort chamber can be produced comprising the steps of:

(A) drilling into and removing a core sample from at least one hole at the bottom of said shale deposit;

(B) subjecting said core sample to controlled heating with accompanying strain measurements to determine the thermomechanical characteristics of the core material from which can be determined the thermal gradients required of said shale deposits so as to produce a fracturing pattern;

(C) inserting piping to the bottom of said hole;

(D) pumping steam down an injection pipe into said shale formation to heat said shale deposits correspondingly to the results derived from said core sample heating and producing corresponding fracturing patterns in said shale and extracting water soluble associated minerals from a producer pipe thereby forming a substantially gas-tight chamber;

(E) injecting hot, pressurized, non-oxidizing gas down said injection pipe to heat said shale deposit correspondingly to said core sample heating whereby said associated minerals are decomposed and further fractured with appropriate time-temperature cycles by heat and hydrocarbon fluids are extracted from said producer pipe;

(F) injecting a portion of said water soluble mineral values previously obtained and a surfactant down said injection pipe and extracting said decomposed minerals and hydrocarbon fluids from said producing well;

(G) clearing said chamber;

(H) instituting a flame front with air and water to combust hydrocarbon residue and extracting hydrocarbon gas from said producer pipe for process heating;

(I) filling said chamber with water; and (J) raising the termination of said injector pipe and said producer pipe a predetermined distance to begin the formation of the next gas-tight chamber in said shale deposit.

9. A process according to claim 8 wherein said shale deposit is beneath a layered salt deposit.

10. A process according to claim 8 wherein said associated minerals are selected from the group consisting of nahcolite, dawsonite, nordstrandite, shortite, trona, and halite.

11. A process according to claim 8 wherein said water soluble mineral is selected from the group consisting of halite, trona, and nahcolite.

12. A process according to claim 8 wherein said hot, pressurized gas is selected from the group consisting of low molecular weight hydrocarbons, carbon dioxide, hydrogen, carbon monoxide, nitrogen, steam, and mixtures thereof.

13. A process according to claim 8 wherein said solvent is an aqueous solution of a compound selected from the group consisting of sodium carbonate and sodium bicarbonate and a surfactant selected from the group consisting of alkanol amines, alkanol amides, polyoxyalkylene oxide block copolymers, carboxylic amides, carboxylic esters, ethoxylated aliphatic alcohols, ethoxylated alkylphenols, polyoxyethylenes, alkyl sulfates, N-acyl-N-alkyltaurates, naphthalene sulfonates, alkyl benzene sulfonates, alkane sulfonates, alkanol amide sulfates, sulfated alkylphenols, and phosphate esters.

14. A process according to claim 8 wherein said decomposed minerals are chi alumina.

* * * * *